US009003723B2

(12) United States Patent
Ueki et al.

(10) Patent No.: US 9,003,723 B2
(45) Date of Patent: Apr. 14, 2015

(54) STEEL PIPE STIFFENING BRACE MEMBER AND MANUFACTURING METHOD THEREOF

(75) Inventors: Takuya Ueki, Kanagawa (JP); Hiroumi Shimokawa, Tokyo (JP); Munetada Yamaji, Kanagawa (JP); Taku Funaba, Kanagawa (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/883,127

(22) PCT Filed: Nov. 5, 2010

(86) PCT No.: PCT/JP2010/070158

§ 371 (c)(1),
(2), (4) Date: May 30, 2013

(87) PCT Pub. No.: WO2012/060020

PCT Pub. Date: May 10, 2012

(65) Prior Publication Data

US 2014/0150372 A1 Jun. 5, 2014

(51) Int. Cl.

| | |
|---|---|
| ***E04H 9/02*** | (2006.01) |
| ***E04C 5/01*** | (2006.01) |
| *E04C 3/02* | (2006.01) |

(52) U.S. Cl.

CPC *E04C 5/012* (2013.01); *E04H 9/02* (2013.01); *E04H 9/028* (2013.01); *E04C 2003/026* (2013.01)

(58) Field of Classification Search

CPC ..... E04B 1/58; E04B 1/98; E04B 1/985; E04H 9/02; E04H 9/021; E04H 9/023; E04H 9/024; E04H 9/025

USPC ..... 52/1, 167.1, 167.2, 167.3, 167.4, 838, 52/843, 855, 638, 695, 741.1; 138/172, 138/174; 219/137 R

See application file for complete search history.

(56) References Cited

U.S. PATENT DOCUMENTS 5,159,175 A * 10/1992 Loeber ..... 219/137 R
6,530,182 B2 * 3/2003 Fanucci et al. ..... 52/167.3

(Continued)

FOREIGN PATENT DOCUMENTS

JP 11310958 A * 11/1999 ..... E04B 1/24
JP 2000-226813 8/2000

(Continued)

OTHER PUBLICATIONS

International Search Report, PCT/JP2010/070158, Dec. 21, 2010.

*Primary Examiner* — Beth Stephan
(74) *Attorney, Agent, or Firm* — Young & Thompson

(57) ABSTRACT

A method of manufacturing a steel pipe stiffening brace member which has a shaft constituted of a main shaft member and an auxiliary shaft member and a stiffening steel pipe obtained by connecting side edges of four flat steels surrounding the shaft to each other. In the stiffening steel pipe, inside nook portions facing a side edge of the main shaft member are formed in stiffening members 25 and 26 having a V- or L-shaped cross section by fillet welding, and outside corner portions 25*b* and 26*b* are formed in the stiffening members 25 and 26 by partial penetration welding. Thereafter, side edges of the stiffening members 25 and 26 are abutted against each other, outside corner portions 27*b* and 28*b* are temporarily assembled by partial penetration welding, and outside corner portions 25*b* and 26*b* and outside corner portions 27*b* and 28*b* are subjected to partial penetration welding.

18 Claims, 9 Drawing Sheets

(56) References Cited

U.S. PATENT DOCUMENTS

| | | | | |
|---|---|---|---|---|
| 6,591,573 | B2 * | 7/2003 | Houghton | 52/656.9 |
| 7,373,758 | B2 * | 5/2008 | Tsai et al. | 52/834 |
| 8,590,258 | B2 * | 11/2013 | Hinchman | 52/741.1 |
| 2003/0222188 | A1 * | 12/2003 | Smelser et al. | 248/188.91 |
| 2005/0005539 | A1 * | 1/2005 | Nakamura et al. | 52/167.3 |
| 2006/0101733 | A1 * | 5/2006 | Jen et al. | 52/167.1 |
| 2006/0207983 | A1 * | 9/2006 | Myers et al. | 219/137 PS |
| 2007/0056225 | A1 * | 3/2007 | Takeuchi et al. | 52/167.1 |
| 2009/0019809 | A1 | 1/2009 | Kiji et al. | |
| 2010/0005737 | A1 * | 1/2010 | Tsai et al. | 52/167.3 |

FOREIGN PATENT DOCUMENTS

| | | |
|---|---|---|
| JP | 2001-132112 | 5/2001 |
| JP | 2001-214541 | 8/2001 |
| JP | 2003-239393 | 8/2003 |
| JP | 2008-196108 | 8/2008 |
| JP | 2009-022963 | 2/2009 |

* cited by examiner (a)

(b)

STEEL PIPE STIFFENING BRACE MEMBER AND MANUFACTURING METHOD THEREOF

TECHNICAL FIELD

The present invention relates to a steel pipe stiffening brace member and a manufacturing method thereof, and relates particularly to a steel pipe stiffening brace member to be installed in steel structures such as buildings and a manufacturing method thereof.

BACKGROUND ART

In a steel pipe stiffening brace member to be installed in steel structures, a shaft member formed of flat steel is inserted into a position of a diagonal of a stiffening steel pipe, and out-of-plane (direction at right angles to the longitudinal direction) deflection is restrained when a compressive force acts in the longitudinal direction of the shaft member, thereby energy absorption capacity is increased.

At that time, even if the shaft member and an inner surface of the stiffening steel pipe are slid, in order to prevent generation of frictional noise and reduce friction, a liner plate is inserted into a gap between them, or in order to realize reliable installation in steel structures, a joint member (hereinafter referred to as an "end member") with a width larger than the length of the diagonal of the stiffening steel pipe is installed at an end in a longitudinal direction of the shaft member.

There has been disclosed a method of manufacturing a brace member (the same as the steel pipe stiffening brace member) which facilitates insertion of a liner plate and can enhance the degree of freedom in the shape of an end member (for example, see Patent Literature 1).

CITATION LIST

Patent Literature

Patent Literature 1: Japanese Patent Application Laid-Open No. 2001-132112 (pp. 3 to 4, FIG. 2)

SUMMARY OF INVENTION

Technical Problem

In the method of manufacturing a brace member disclosed in Patent Literature 1, a pair of steel plates is subjected to bending work to have a U-shaped or V-shaped (hereinafter also referred to as L-shaped, and the same is applied to the following description) cross section, and the steel plates are arranged to surround the shaft member. The side edges of the steel plates are connected to each other by welding to form a stiffening steel pipe having a rectangular cross section.

Thus, the liner plate is easily disposed, and, at the same time, the accuracy of a gap is enhanced, thereby a stiffening effect is enhanced. Although the shape of the end member can be selected without being influenced by the size of the stiffening steel pipe, there has been the following problems.

(a) Since the stiffening steel pipe is long, a pressing machine with a considerably high performance is required in order to perform bending work of long flat steel with high accuracy. Thus, a fabricator is limited due to the restriction on equipment for fabrication.

(b) In a stiffening steel pipe formed by applying bending working to flat steel, the radius of curvature of an outside corner portion of the stiffening steel pipe facing the shaft member is required to be 10 times or more the sheet thickness of flat steel when the sheet thickness of flat steel is not less than 6 mm. When the curvature radius is less than 10 times the sheet thickness, special material certification is required to be obtained (see, Building Standard Law "First No. 3, ha, Notification No. 2464 of the Ministry of Construction, 2000"). Thus, the special material certification is required to be obtained in order to reliably suppress out-of-plane buckling.

Thus, as a method of manufacturing a stiffening steel pipe which eliminates the need for bending work and can be disposed so as to surround a shaft member, a method of welding four flat steels into a rectangular shape to assemble the flat steels (hereinafter referred to as "welding tetrahedral box") is considered. However, when the welding tetrahedral box is used as a stiffening steel pipe having a steel pipe stiffening brace member, there has been the following problems.

(c) Since the force of pressing and expanding a stiffening steel pipe from the inside by out-of-plane buckling of the main shaft member is applied near aside edge of the main shaft member, if partial penetration welding causing a non-welded portion on a sheet thickness inner surface side is used in the welding of the corner of the steel pipe, a stiffening effect is reduced, and this becomes a starting point of fracture of the steel pipe.

(d) In the welding of the corner of the steel pipe, when full penetration welding in which the entire sheet thickness is welded is used, backing metal needs to be provided inside the steel pipe (on the steel pipe inner surface side), and the backing metal is in contact with the shaft member or the liner plate, so that an appropriate clearance cannot be secured.

To solve the above problems, the present invention provides a method of manufacturing a steel pipe stiffening brace member, which eliminates the need for bending work of flat steel, prevents fracture of a steel pipe, and can form a stiffening steel pipe which can secure an appropriate clearance, and a steel pipe stiffening brace member manufactured by the manufacturing method.

Solution to Problem (1) A steel pipe stiffening brace member according to the present invention includes: a main shaft member formed of flat steel; and a stiffening steel pipe which surrounds the main shaft member to restrain out-of-plane deformation of the main shaft member, wherein side edges of four flat steels are butted to form an outside corner portion by partial penetration welding and form a steel pipe inside nook portion facing a side edge of the main shaft member by fillet welding, thereby the stiffening steel pipe is formed to have a rectangular cross-sectional shape.

(2) In the steel pipe stiffening brace member according to (1), a liner plate is disposed in a gap between the inside nook portion of the stiffening steel pipe subjected to fillet welding and the side edge of the main shaft member.

(3) In the steel pipe stiffening brace member according to (1) or (2), an auxiliary shaft member formed of flat steel is installed on a side surface of the main shaft member.

(4) In the steel pipe stiffening brace member according to any of (1) to (3), an end member formed of flat steel with a width larger than a length of a diagonal of the stiffening steel pipe is installed at an end in a longitudinal direction of the main shaft member.

(5) A method of manufacturing a steel pipe stiffening brace member according to the present invention having a main shaft member formed of flat steel and a stiffening steel pipe surrounding the main shaft member to restrain out-of-plane deformation of the main shaft member, including the steps of:

butting side edges of a pair of flat steels to permanently weld an inside nook portion by fillet welding and intermittently temporarily weld an outside corner portion in a longitudinal direction by partial penetration welding, and, thus, to form a stiffening member having a V-shaped cross section;

butting side edges of a pair of the stiffening members in such a state that the side edge of the main shaft member faces the permanently welded inside nook portion of the stiffening member to intermittently temporarily weld the outside corner portion in the longitudinal direction by partial penetration welding, and, thus, to temporarily assemble the stiffening steel pipe having a rectangular cross section; and permanently welding the temporarily welded outside corner portion of the stiffening steel pipe by partial penetration welding and permanently assembling the stiffening steel pipe.

(6) In the method of permanently assembling the stiffening steel pipe according to (5), among the temporarily welded outside corner portions of the stiffening steel pipe, two outside corner portions are simultaneously permanently welded.

(7) The method according to (5) or (6) further includes, before the step of temporarily assembling the stiffening steel pipe, disposing a liner plate in a gap between the permanently welded inside nook portion of the stiffening member and the side edge of the main shaft member.

(8) In the method according to any of (5) to (7), an auxiliary shaft member formed of flat steel is installed on a side surface of the main shaft member.

(9) In the method according to any of (5) to (8), an end member formed of flat steel with a width larger than a length of a diagonal of the stiffening steel pipe is installed at an end in a longitudinal direction of the main shaft member.

Advantageous Effects of Invention (i) A steel pipe stiffening brace member according to the present invention is formed to have a rectangular cross section by butting side edges of four flat steels to form an outside corner portion by partial penetration welding and, at the same time, form a steel pipe inside nook portion facing a side edge of a main shaft member by fillet welding. Thus, the need for bending work of flat steel is eliminated, and, at the same time, fracture of the stiffening steel pipe can be prevented against a push-out force from the inside of the steel pipe according to out-of-plane buckling of the main shaft member.

Although the inner surface nook portion except for the steel pipe inside nook portion facing the side edge of the main shaft member is not subjected to fillet welding, a stress less than the stress applied to the former occurs in the latter, and therefore, the stiffening steel pipe is not fractured.

Further, since backing metal is not required to be attached to the steel pipe inside nook portion facing the side edge of the main shaft member, an appropriate clearance can be secured between the stiffening steel pipe and the shaft member or the liner plate.

(ii) Since the liner plate is disposed in a gap between the inside nook portion of the stiffening steel pipe and the side edge of the main shaft member, out-of-plane deformation (deflection) of the main shaft member can be appropriately restrained, and, at the same time, even if both are slid, it is possible to prevent generation of frictional noise and reduce friction.

(iii) Further, since an auxiliary shaft member formed of flat steel is installed on a side surface of the main shaft member, out-of-plane deformation to a compression force in a longitudinal direction is restrained, and absorption energy is increased.

(iv) Furthermore, since an end member formed of flat steel with a width larger than a length of a diagonal of the stiffening steel pipe is installed at an end in a longitudinal direction of the main shaft member, reliable connection to steel structures is realized, and energy absorption of the main shaft member is more reliably performed.

(v) Furthermore, a method of manufacturing a steel pipe stiffening brace member according to the present invention includes a process of forming a stiffening member by permanently welding an inside nook by fillet welding and temporarily welding an outside corner portion by partial penetration welding, a process of temporarily assembling a stiffening steel pipe by temporarily welding the outside corner portion by partial penetration welding, and a process of permanently assembling the stiffening steel pipe by permanently welding the outside corner portion by partial penetration welding, thereby the stiffening steel pipe can be formed while eliminating the need for bending work of flat steel and, at the same time, suppressing bentness or warpage of the steel pipe due to influence of welding heat.

(vi) Furthermore, since two outside corner portions of the stiffening steel pipe of the temporarily welded outside corner portions are simultaneously permanently welded by semiautomatic welding machines arranged in parallel to permanently assemble the stiffening steel pipe, the number of times of rotating the steel pipe stiffening brace member in the welding is reduced, and the manufacturing process can be abbreviated.

(vii) The method of manufacturing a steel pipe stiffening brace member further includes a process of disposing the liner plate before the process of temporarily assembling the stiffening steel pipe, thereby the liner plate can be easily disposed, and, at the same time, the accuracy of a gap is enhanced to enhance a stiffening effect.

(viii) Furthermore, since an auxiliary shaft member formed of flat steel is installed on a side surface of the main shaft member, out-of-plane deformation to a compression force in a longitudinal direction is restrained, and absorption energy is increased.

(ix) Since an end member does not penetrate through the inside of the stiffening steel pipe upon manufacturing, the size and shape of the end member are not affected by the size of the stiffening steel pipe. Accordingly, the end member formed of flat steel with a width larger than the length of the diagonal of the stiffening steel pipe can be installed, reliable connection to steel structures is realized, and energy absorption of the main shaft member is more reliably performed.

DESCRIPTION OF EMBODIMENTS

First Embodiment

Figure 1:
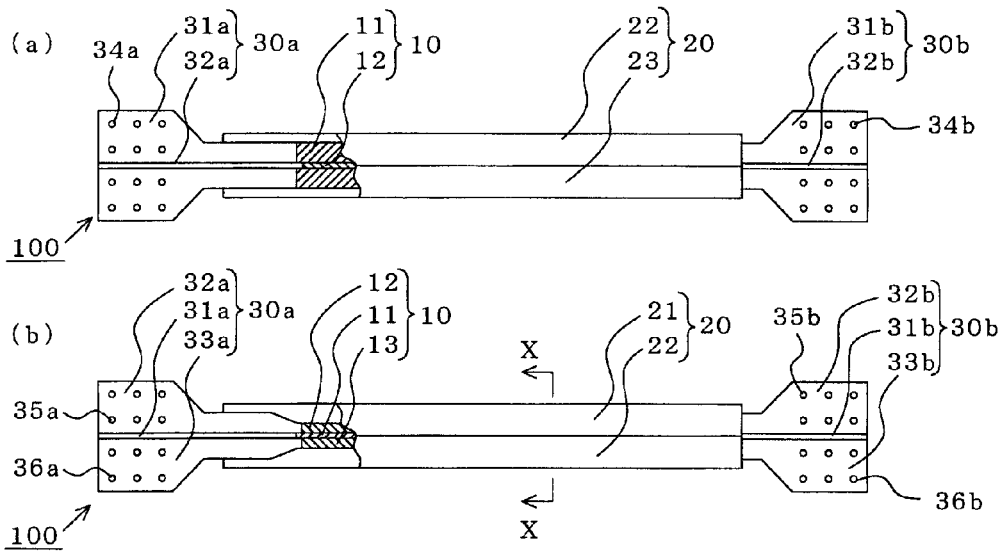
FIGS. 1(*a*) and 1(*b*) are, respectively, a plan view and a side view showing a steel pipe stiffening brace member according to the first embodiment of the present invention.
Figure 2:
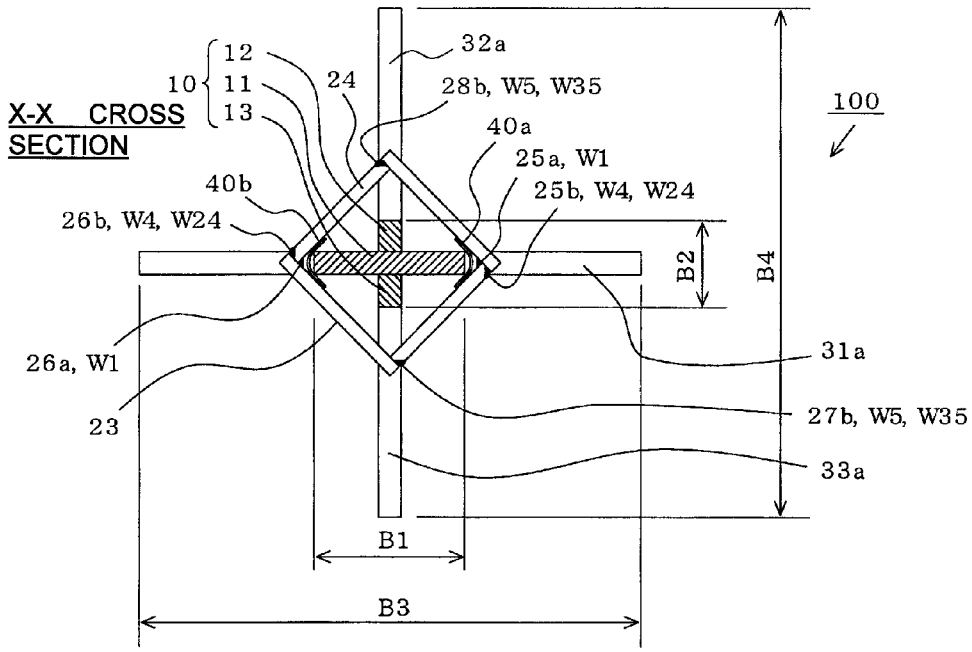
FIGS. 2(*a*) and 2(*b*) are front cross-sectional views showing the steel pipe stiffening brace member according to the first embodiment of the present invention.
Figure 2:
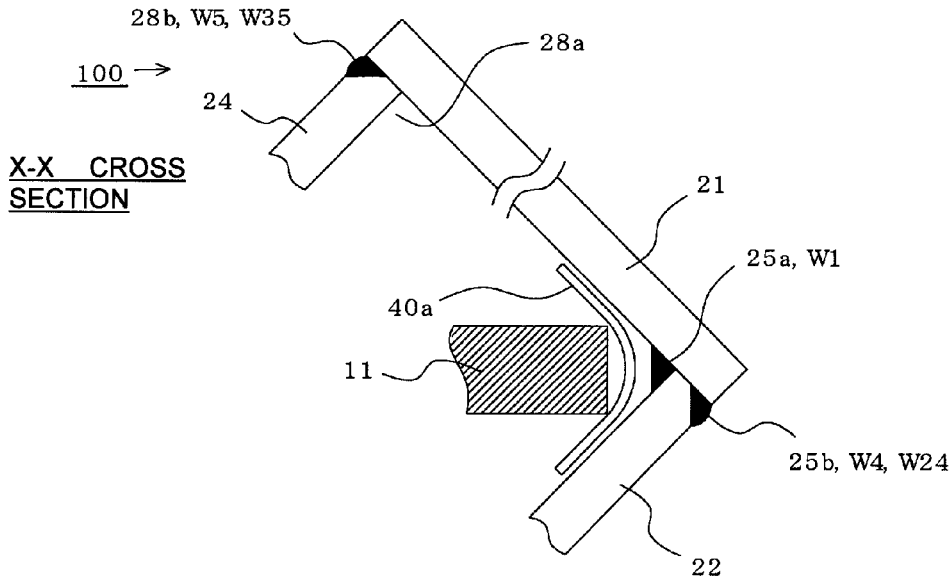

FIGS. 1 and 2 are views for explaining a steel pipe stiffening brace member according to a first embodiment of the present invention. FIG. 1(*a*) is a plan view, and FIG. 1(*b*) is a side view. FIG. 2(*a*) is a front cross-sectional view (X-X cross section in FIG. 1(*b*)), and FIG. 2(*b*) is a partially enlarged front cross-sectional view of FIG. 2(*a*). Those views are schematic views, and the relative size of each member, sheet thickness, and the like are not limited to illustrated dimension. In the description of common members, suffixes "a" and "b" of reference numerals are omitted.

(Steel Pipe Stiffening Brace Member)

In FIGS. 1 and 2, a steel pipe stiffening brace member 100 has a shaft member 10, a stiffening steel pipe 20 surrounding the shaft member 10 for restraining out-of-plane deformation of a main shaft member, end members (corresponding to joint members) 30*a* and 30*b* fixed to both ends in the longitudinal direction of the shaft member 10 respectively for realizing reliable installation to steel structures (not shown), and liner plates 40*a* and 40*b* arranged in a gap between a side edge of the shaft member 10 and an inner surface of the stiffening steel pipe 20.

(Shaft Member)

The shaft member 10 is constituted of a main shaft member 11 formed of a flat steel shorter than the stiffening steel pipe 20 and auxiliary shaft members 12 and 13 formed of flat steels fixed to both side surfaces of the main shaft member 11 and has a cross-shaped cross section. At this time, a distance (hereinafter referred to as "width B2") between a side edge of the auxiliary shaft member 12 and a side edge of the other auxiliary shaft member 13 is smaller than a distance (hereinafter referred to as "width B1") between both side edges of the main shaft member 11 (B2<B1).

The present invention is not limited to the embodiment illustrating the shaft member 10, and only the main shaft member 11 may be provided without fixing the auxiliary shaft members 12 and 13.

(Stiffening Steel Pipe)

The stiffening steel pipe 20 has a tubular shape with a square cross section longer than the shaft member 10, and side edges of four flat steels 21, 22, 23, and 24 are connected to each other by welding.

Namely, a side end surface of the flat steel 22 is abutted against a side surface of the flat steel 21 to provide a V-shaped cross section, and an inside nook portion (abutting portion on a concave surface side) 25*a* is connected by fillet welding W1, and an outside corner portion (abutting portion on a convex surface side) 25*b* is connected by partial penetration welding W4 (intermittent partial penetration welding W24 in the longitudinal direction).

The fillet welding W1 and the partial penetration welding W4 (the intermittent partial penetration welding W24 in the longitudinal direction) are similarly performed at an inside nook portion 26*a* and an outside corner portion 26*b* at which the flat steels 23 and 24 are abutted against each other.

Further, the side end surface of the flat steel 24 is abutted against the side surface of the flat steel 21 to provide a V-shaped cross section, and a corner portion (abutting portion on the convex surface side) 28*b* is connected by partial penetration welding W5 (intermittent partial penetration welding W35 in the longitudinal direction). At this time, a corner portion (abutting portion on the concave surface side) is not subjected to fillet welding. Note that since connection between the flat steel 23 and the flat steel 22 is similar to above, the description will be omitted.

The stiffening steel pipe 20 is formed by the above welding method and thus is less likely to cause bentness and warpage, and therefore, the stiffening steel pipe 20 is not required to be straightened (this will be described in detail in a second embodiment).

(End Member)

The end members 30*a* and 30*b* (hereinafter correctively or individually referred to as "end member 30") have a main end member 31 fixed to an end in the longitudinal direction of the main shaft member 11 and auxiliary end members 32 and 33 fixed to an end in the longitudinal direction of the auxiliary shaft members 12 and 13. The auxiliary end members 32 and 33 are fixed to both side surfaces of the main end member 31 to provide a cross-shaped cross section.

At that time, the width of the main end member 31 and the auxiliary end member 32 is small within a range close to the stiffening steel pipe 20 in a longitudinal direction, and the main end member 31 and the auxiliary end member 32 enter inside the stiffening steel pipe 20. Meanwhile, near the end in the longitudinal direction projecting from the stiffening steel pipe 20, a distance between both side edges of the main end member 31 (hereinafter referred to as "width B3") and a distance between the side edge of the auxiliary end member 32 and the side edge of the other auxiliary end members 33 (hereinafter referred to as "width B4") are satisfactorily larger than the length of the diagonal of the inner surface of the stiffening steel pipe 20.

In the above description, although the main end member 31 and the auxiliary end members 32 and 33 have through-holes 34 and the like through which a bolt for installation to steel structures penetrates, the present invention is not limited to the illustrated embodiment. For example, the ends of the main end member 31 and the ends of the auxiliary end members 32 and 33 may be connected to a steel structure by welding without providing the through-hole 34 and the like. In this case, a gazette plate whose end is formed into the same shape as an end formed by the main end member 31 and the auxiliary end members 32 and 33 is installed in the steel structure.

(Liner Plate)

The liner plate 40 is disposed in a gap between the side edge of the main shaft member 11 and the inner surface of the stiffening steel pipe 20. In the out-of-plane deformation (deflection) of the main shaft member 11, a deformation volume restraining out-of-plane deformation is properly set, and the stiffening effect is enhanced. The side edge of the main shaft member 11 and the inner surface of the stiffening steel pipe 20 are abutted against each other through the liner plate 40 and do no directly slid, and thereby it contributes to prevention of generation of frictional noise and reduction of friction.

A material forming the liner plate is not limited to a specific one, and hard synthetic resin may be used, or natural rubber, artificial rubber, or the like may be used.

Second Embodiment

Figure 3:
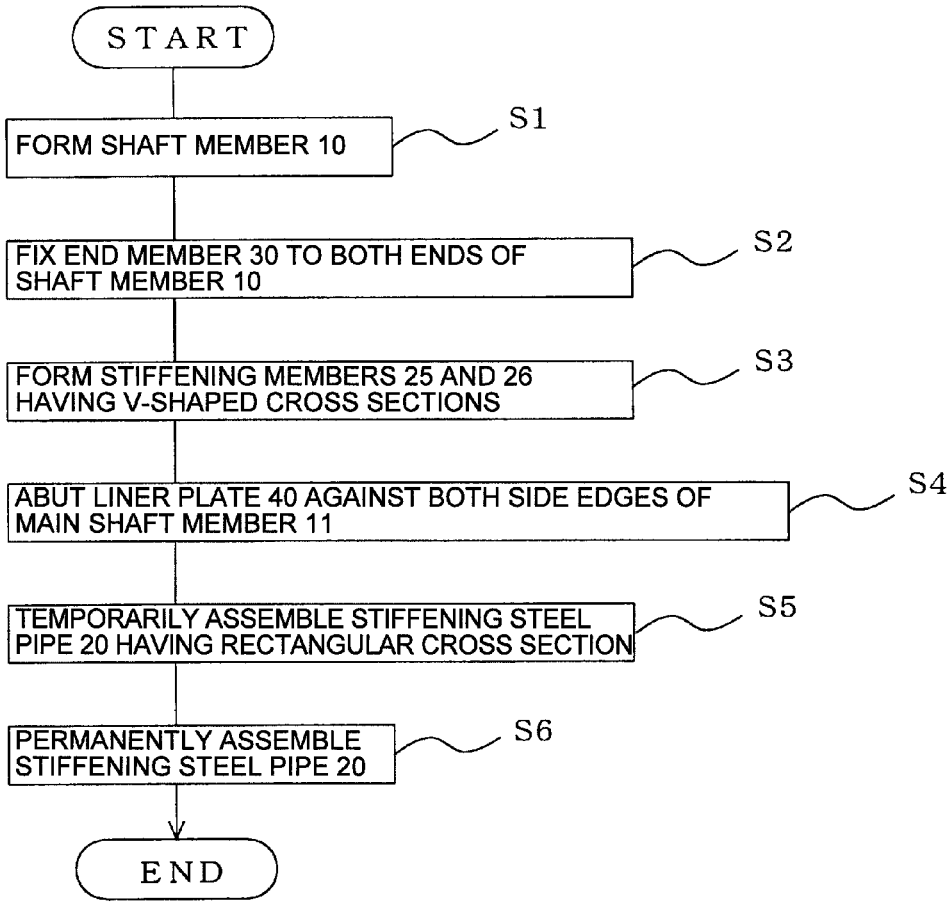
FIG. 3 is a flow chart for explaining a method of manufacturing a steel pipe stiffening brace member according to a second embodiment of the present invention.
Figure 4:
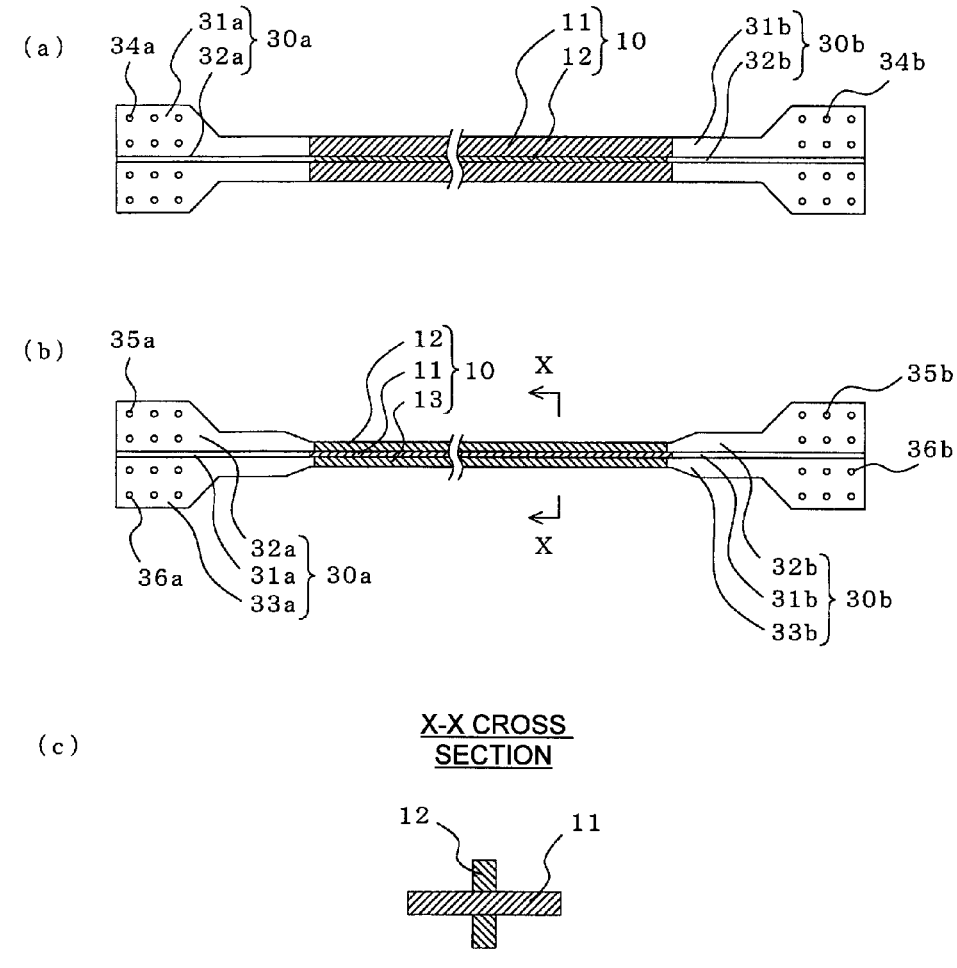
FIGS. 4(*a*) to 4(*c*) are, respectively, a plan view, aside view, and a front cross-sectional view schematically showing each process of the method of manufacturing a steel pipe stiffening brace member according to the second embodiment of the present invention.
Figure 5:
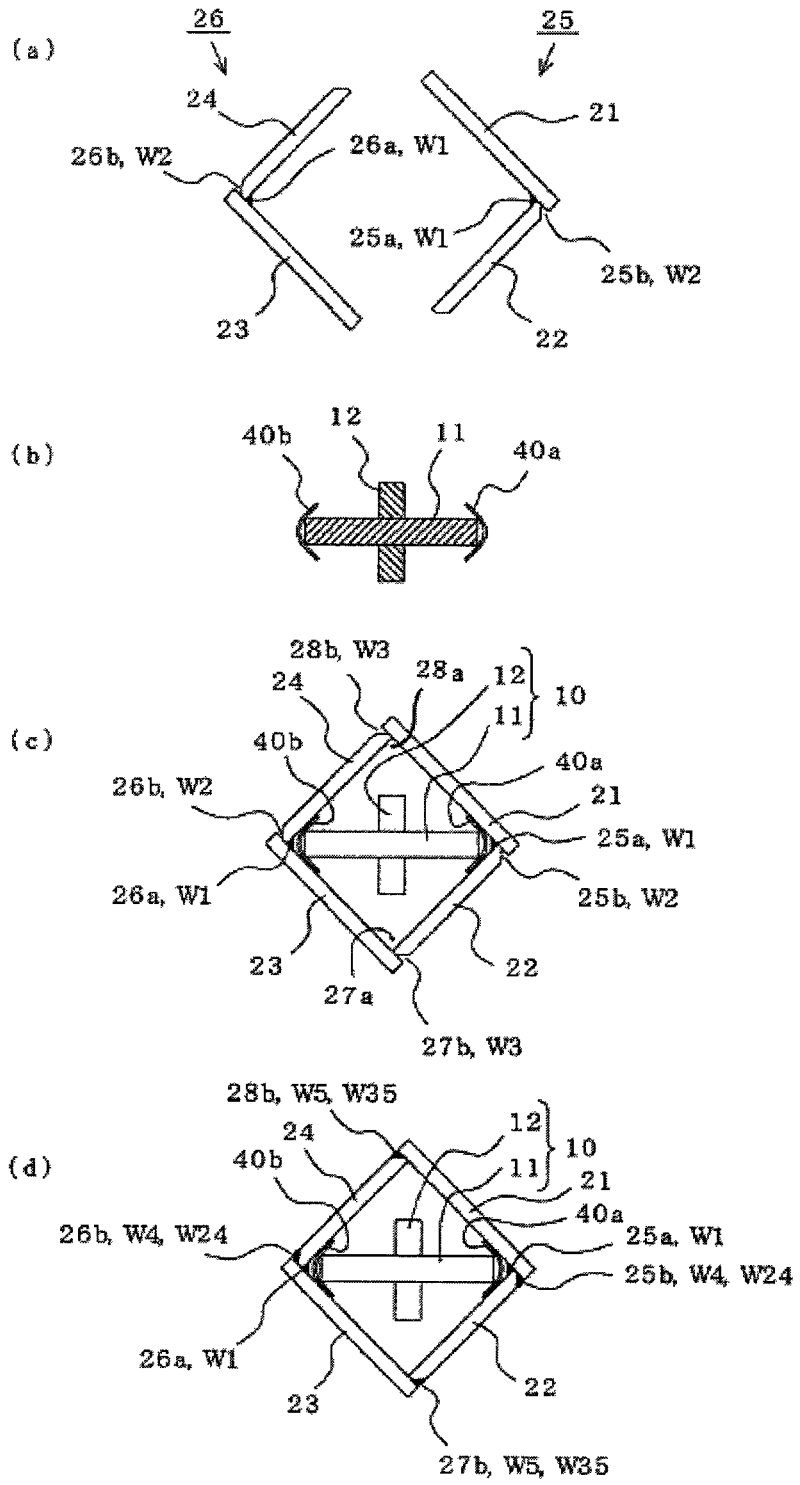
FIGS. 5(*a*) to 5(*d*) are front cross-sectional views schematically showing each process of the method of manufacturing a steel pipe stiffening brace member according to the second embodiment of the present invention.

FIGS. 3 to 5 are views for explaining a method of manufacturing a steel pipe stiffening brace member according to a second embodiment of the present invention. FIG. 3 is a flow chart showing each process. FIG. 4(*a*) is a plan view schematically showing each process. FIG. 4(*b*) is a side view of FIG. 4(*a*). FIG. 4(*c*) is a front cross-sectional view of FIG. 4(*a*) (X-X cross section in FIG. 4 (*b*)). FIGS. 5(*a*) to 5(*d*) are front cross-sectional views schematically showing each process. The same or corresponding components as those of the first embodiment are assigned the same reference numerals, and description thereof is partially omitted.

In FIGS. 3 and 4, the method of manufacturing a steel pipe stiffening brace member includes a first process (S1) of fixing the auxiliary shaft members 12 and 13 formed of flat steel to both side surfaces of the main shaft member 11 formed of flat steel and forming the shaft member 10 having a cross-shaped cross section and a second process (S2) of fixing the end members 30*a* and 30*b* having a cross-shaped cross section to both ends of the shaft member 10.

At that time, the auxiliary end members 32 and 33 are fixed to both side surfaces of the main end member 31 to form the end member 30 having a cross-shaped cross section; thereafter, the main end member 31 may be fixed to the main shaft member 11, and the auxiliary end members 32 and 33 may be fixed respectively to the auxiliary shaft members 12 and 13. Alternatively, the main end member 31 is fixed to the main shaft member 11, and the auxiliary end members 32 and 33 are fixed respectively to the auxiliary shaft members 12 and 13, and then the end member 30 having a cross-shaped cross section may be formed.

Alternatively, the main end member 31 and the main shaft member 11 are connected to each other, and the auxiliary end members 32 and 33 and the auxiliary shaft members 12 and 13 may be fixed to the main end member 31 and the main shaft member 11 in the connected state, namely, the first and second processes may be simultaneously executed.

In FIGS. 3 and 5(*a*), stiffening members 25 and 26 are then formed. Namely, the method of manufacturing a steel pipe stiffening brace member includes a third process (S3) of abutting an end surface of the flat steel 22 against the side surface of the flat steel 21 to form a V-shaped cross section, and, thus, to permanently weld the inside nook portion 25*a* by the fillet welding W1, and, at the same time, intermittently temporarily weld a corner portion 25*b* on a convex surface side (hereinafter referred to as an "outside corner portion") in the longitudinal direction by partial penetration welding W2, thereby the stiffening member 25 having a V-shaped cross section is formed, and the stiffening member 26 is formed in a similar manner. Hereinafter, the abutting portion may be referred to as "main shaft member nook portion".

At that time, since a chamfering (C chamfering) process is previously applied to both side edges of the flat steel 22, an outer surface corner portion has a single bevel groove (single edge beveling) whose bottom is located at an intermediate portion of the sheet thickness of the flat steel 22. With regard to the flat steels 23 and 24, the stiffening member 26 is formed in a similar manner.

In the partial penetration welding W2, a penetration depth is smaller than the sheet thickness of the flat steel 22, and non-welded portions remain. There is intermittent welding penetration in the longitudinal direction (the axial direction of the stiffening steel pipe 20). The partial penetration welding W2 means paddings of single or few layers with a length of 50 mm provided at an interval of 1 m.

The method of manufacturing a steel pipe stiffening brace member further includes a fourth process (S4) in FIGS. 3 and 5(*b*) of abutting the liner plates 40*a* and 40*b* against both side edges of the main shaft member 11 of the shaft member 10.

In FIGS. 3 and 5C, the stiffening steel pipe 20 surrounding the shaft member 10 is then temporarily assembled. Namely, the manufacturing method furthermore includes a fifth process (S5) of surrounding the shaft member 10 with the stiffening members 25 and 26 so that both side edges of the main shaft member 11 of the shaft member 10 face the inside nook portions of the stiffening members 25 and 26 through the liner plates 40 and, at the same time, abutting the side edges of the stiffening members 25 and 26 (to be precise, the side edges of the flat steels 22 and 23 and the side edges of the flat steels 24 and 21) against each other to intermittently temporarily weld the outside corner portions 27*b* and 28*b* in the longitudinal direction by partial penetration welding W3, and, thus, to temporarily assemble the stiffening steel pipe 20 having a rectangular cross section.

At that time, inside nook portions 27*a* and 28*a* formed at the abutting portion (hereinafter also referred to as "auxiliary shaft member nook portion") between the side edges of the stiffening members 25 and 26 are not subjected to welding. In accordance with the partial penetration welding W2, in the partial penetration welding W3, the penetration depth is smaller than the sheet thickness of the flat steels 22 and 24, and non-welded portions remain in the sheet thickness direction. Since the partial penetration welding W3 is intermittently performed in the longitudinal direction, a welded portion formed by welding from outside is not melted in the inside nook portions 27*a* and 28*a*.

In FIGS. 3 and 5(*d*), the stiffening steel pipe 20 is then permanently assembled. Namely, the method of manufacturing a steel pipe stiffening brace member furthermore includes a sixth process (S6) of permanently welding the outside corner portions 25*b*, 26*b*, 27*b*, and 28*b*, subjected to the partial penetration welding W2 and W3, by the partial penetration welding W4 and W5 and permanently assembling the stiffening steel pipe 20.

At that time, the outside corner portions 25*b* and 26*b* are intermittently subjected to the partial penetration welding W2 in the longitudinal direction, so that partial penetration welding W24 in which the partial penetration welding W4 is melted on the partial penetration welding W2 is partially executed.

Similarly, the outside corner portions 27*b* and 28*b* are intermittently subjected to the partial penetration welding W3 in the longitudinal direction, so that partial penetration welding W35 in which the partial penetration welding W5 is melted on the partial penetration welding W3 is partially executed.

As described above, in the method of manufacturing a steel pipe stiffening brace member according to the present invention, the shaft member 10 fixed with the end member 30 is surrounded by a pair of the stiffening members 25 and 26 whose outside corner portions 25*b* and 26*b* are temporarily welded. The outside corner portions 27*b* and 28*b* of the pair of the stiffening members 25 and 26 are temporarily welded to temporarily assemble the stiffening steel pipe 20. The stiffening steel pipe 20 is then permanently welded to be permanently assembled in a state of holding the rectangular shape. Therefore, it is possible to eliminate the need for the bending work of the flat steel 21 and the like and form the stiffening steel pipe 20 in which bentness or warpage of the flat steel 21 and the like due to the influence of welding heat in the permanently welding is suppressed.

Third Embodiment

Figure 6:
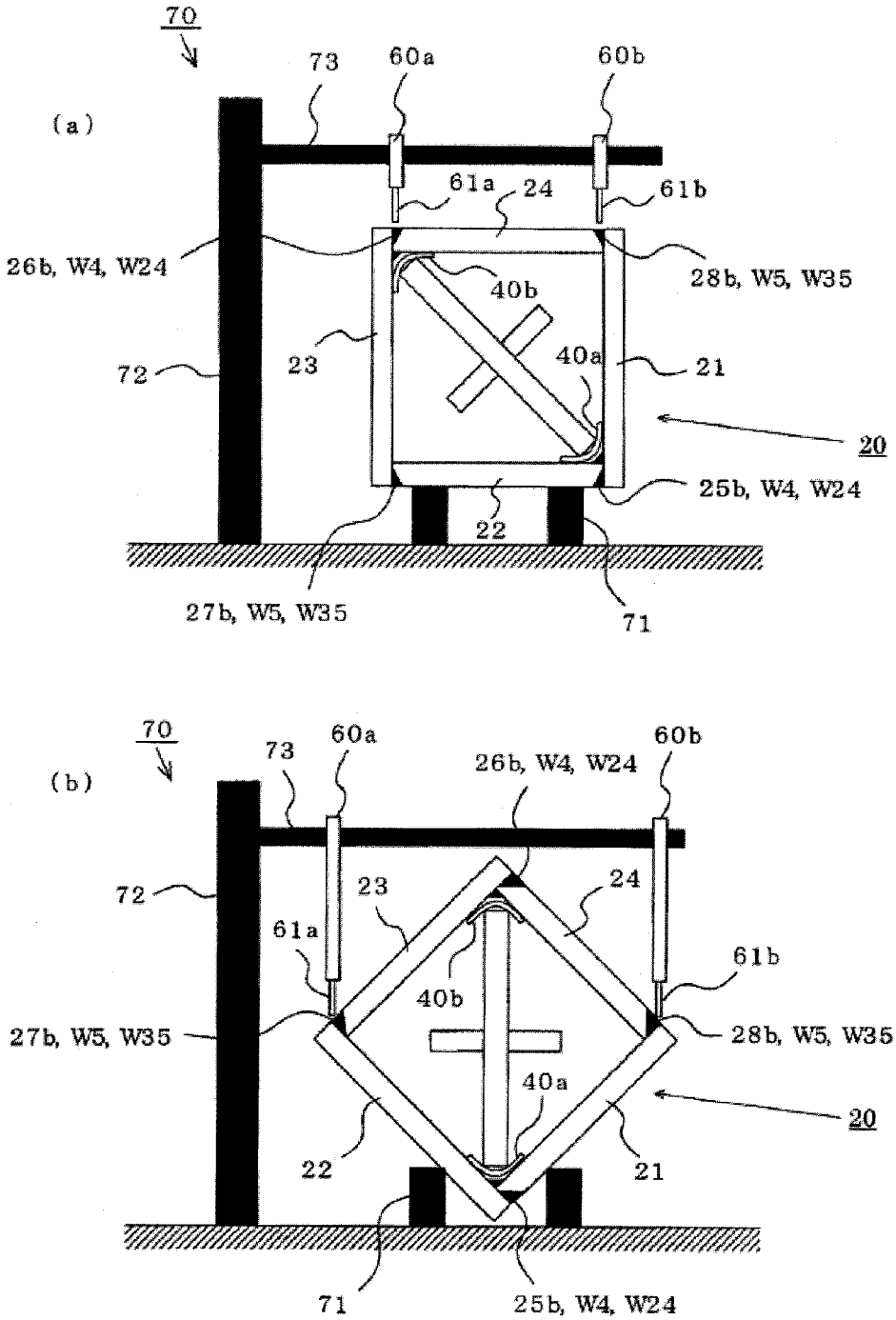
FIGS. 6(*a*) and 6(*b*) are front cross-sectional views schematically showing a sixth process (S6) of a method of manufacturing a steel pipe stiffening brace member according to a third embodiment of the present invention.

FIGS. 6(*a*) and 6(*b*) are views for explaining a method of manufacturing a steel pipe stiffening brace member according to a third embodiment of the present invention and are front cross-sectional views schematically showing the sixth process (S6). The same or corresponding components as those of the second embodiment are assigned the same reference numerals, and description thereof is partially omitted.

In the third embodiment, the sixth process (S6) in the second embodiment is executed by a welding machine (semi-automatic welding machine) provided with two series of welding torches. A welding machine 70 has a working table 71, a working stand 72, a working arm 73 movably installed on the working stand 72, welding torches 60*a* and 60*b* installed in the working arm 73, power supply means (including control means) (not shown) which supplies a predetermined current to the welding torches 60*a* and 60*b*, and material supply means (not shown) which supplies a welding material (such as welding wire and inert gas) to the welding torches 60*a* and 60*b*.

In FIG. 6(*a*), the stiffening steel pipe 20 is placed on the working table 71 by being rotated so that the flat steel 24 (see, FIG. 5(*d*)) having the single bevel grooves on both sides is horizontal and on the topside.

Then, in the installation, torch tip ends 61*a* and 61*b* are located directly above the single bevel grooves (outside corner portions) 26*b* and 28*b* formed on both sides of the flat steel 24.

Thus, the working arm 73 is then moved (the torch tip ends 61*a* and 61*b* run parallel to the longitudinal direction of the stiffening steel pipe 20) to apply partial penetration welding to the outside corner portions 26*b* and 28*b* at once.

Next, the stiffening steel pipe 20 is reversed by 180 degrees and installed so that the flat steel 22 is horizontal and on the topside. Hereinafter, partial penetration welding is applied to the outside corner portions 25*b* and 27*b* at once by a similar procedure.

As described above, among the temporarily welded outside corner portions, the two outside corner portions are simultaneously permanently welded to permanently assemble the stiffening steel pipe 20, and therefore, bentness or warpage of the steel pipe due to influence of welding heat can be suppressed.

Note that either of the flat steel 24 and the flat steel 22 may be welded first.

The present invention does not limit the configuration of the welding machine 70, and the working table 71 may be moved instead of the working arm 73. The welding torches 60*a* and 60*b* may be installed on different working arms.

In FIG. 6(*b*), the single bevel grooves are formed on one side of the flat steel 21, one side of the flat steel 23, and both sides of the flat steel 24. Although the flat steel 22 has no single bevel groove, the outside corner portions 25*b*, 26*b*, 27*b*, and 28*b* are formed at the respective corners in accordance with FIG. 6(*a*).

The stiffening steel pipe 20 is placed on the working table 71 by being rotated so that the outside corner portions 27*b* and 28*b* are horizontal and on the topside.

Thus, in the installation, the torch tip ends 61*a* and 61*b* are located directly above the outside corner portions 27*b* and 28*b*, and the working arm 73 is moved (the torch tip ends 61*a* and 61*b* run parallel to the longitudinal direction of the stiffening steel pipe 20) to apply partial penetration welding to the outside corner portions 27*b* and 28*b* at once.

Next, the stiffening steel pipe 20 is reversed by 180 degrees and installed so that the outside corner portions 25*b* and 26*b* are horizontal and on the topside. Hereinafter, partial penetration welding is applied to the outside corner portions 25*b* and 26*b* at once by a similar procedure.

Accordingly, similar effects obtained by the welding method shown in FIG. 6*a can be obtained.*

Example

Next, there will be described experiments for comparing the performance between an example of the steel pipe stiffening brace member according to the first embodiment (the same as the steel pipe stiffening brace member manufactured by the method of manufacturing a steel pipe stiffening brace member according to the second embodiment and hereinafter also referred to as "welding tetrahedral box type") and a comparative example that is a steel pipe stiffening brace member (hereinafter also referred to as "V-shaped pressing type") obtained by applying bending work to a pair of steel plates to form the cross sections of the pair of steel plates into a V-shape, and, thus, to arrange the pair of steel plates so that the pair of steel plates surrounds a shaft member and welding their end edges to each other to form a stiffening steel pipe having a rectangular cross section.

Figure 7:
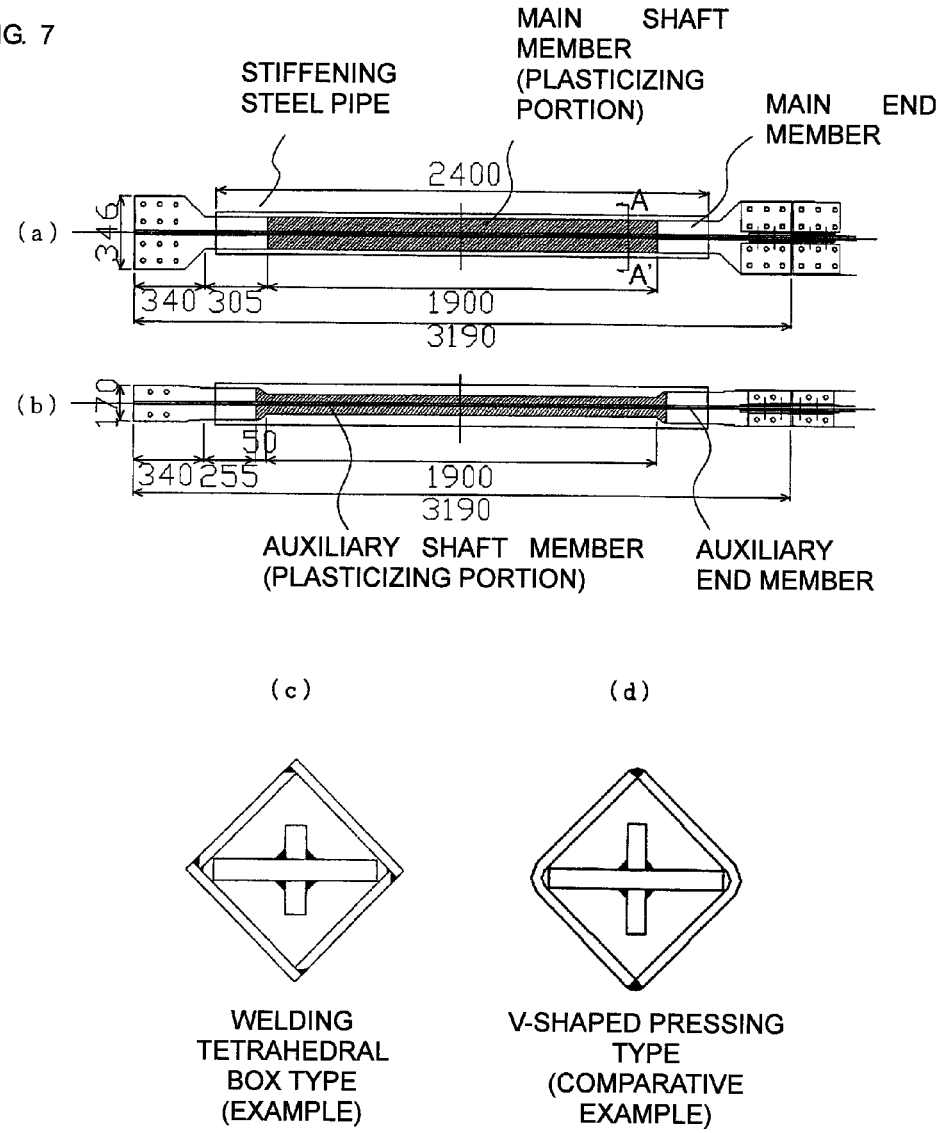
FIGS. 7(*a*) to 7(*d*) are, respectively, a plan view, aside view, and front cross-sectional views of a test body used in a performance comparison experiment in an example.

FIGS. 7(*a*) to 7(*d*) is a view for explaining a test body used in the experiment. FIG. 7(*a*) is a plan view of the example. FIG. 7(*b*) is a side view of the example. FIG. 7C is a front cross-sectional view of the example (A-A cross section in FIG. 7(*a*)). FIG. 7(*d*) is a front cross-sectional view of the comparative example.

In the example in FIGS. 7(*a*) to 7(*c*), when the sheet thickness of a steel pipe is 9 mm, in the inside fillet welding, the leg length is 3 mm. In outside partial penetration welding, the groove angle is 45 degrees, and the groove depth is 7 mm.

In FIG. 7(*d*), in the comparative example, although the shape of the cross section of the shaft member, the steel pipe diameter, and the sheet thickness are the same as those in the example, a method of manufacturing a stiffening steel pipe is different from that in the example.

Table 1 shows specifications of the example and the comparative example and the results of a constant amplitude loading test.

"Repeat count" in Table 1 is an index showing fatigue characteristics as a steel pipe stiffening brace member and shows the number of times of repetition until the bearing force is reduced from the maximum bearing force of the shaft member to 70% of the maximum bearing force. "Cumulative plastic deformation ratio" in Table 1 is an index showing the energy absorption capacity as a steel pipe stiffening brace member and shows a value obtained by dividing an inside area of a hysteresis curve (bearing force–deformation curve) obtained until reaching the repeat count by a rectangular area of "yield resistance×yield deformation".

TABLE 1

| Test body | Shaft member: Steel grade | Shaft member: Cross-sectional shape | Stiffening steel plate: Steel grade | Stiffening steel plate: Cross-sectional shape | Stiffening steel plate: Fabrication method | Experimental result: Repeat count | Experimental result: Cumulative plastic deformation ratio |
|---|---|---|---|---|---|---|---|
| Example | LY225 | $152^B \times 94^H \times 16^t$ | SS400 | $140^D \times 9^t$ | Welding tetrahedral box type | 48 | 2064 |
| Comparative Example | LY225 | $152^B \times 94^H \times 16^t$ | SS400 | $140^D \times 9^t$ | V-shaped pressing type | 45 | 2240 |

In Table 1, the repeat count in the example (welding tetrahedral box type) is slightly greater than that in the comparative example (V-shaped pressing type).

Meanwhile, although the cumulative plastic deformation ratio in the example is slightly lower than that in the comparative example, both cumulative plastic deformation ratios are satisfactorily large values in comparison with "300" that is a necessary cumulative plastic deformation ratio corresponding to two large earthquakes. Since it can be said that a difference between them falls within a range of variation, the example is equivalent to the comparative example, and it can be said that the example has a satisfactory performance.

In the example, a rapid lowering of the bearing force does not occur even after the bearing force is less than 70% of the maximum bearing force, and fracture at a steel pipe welding portion does not occur finally.

(Variation)

Figure 8:
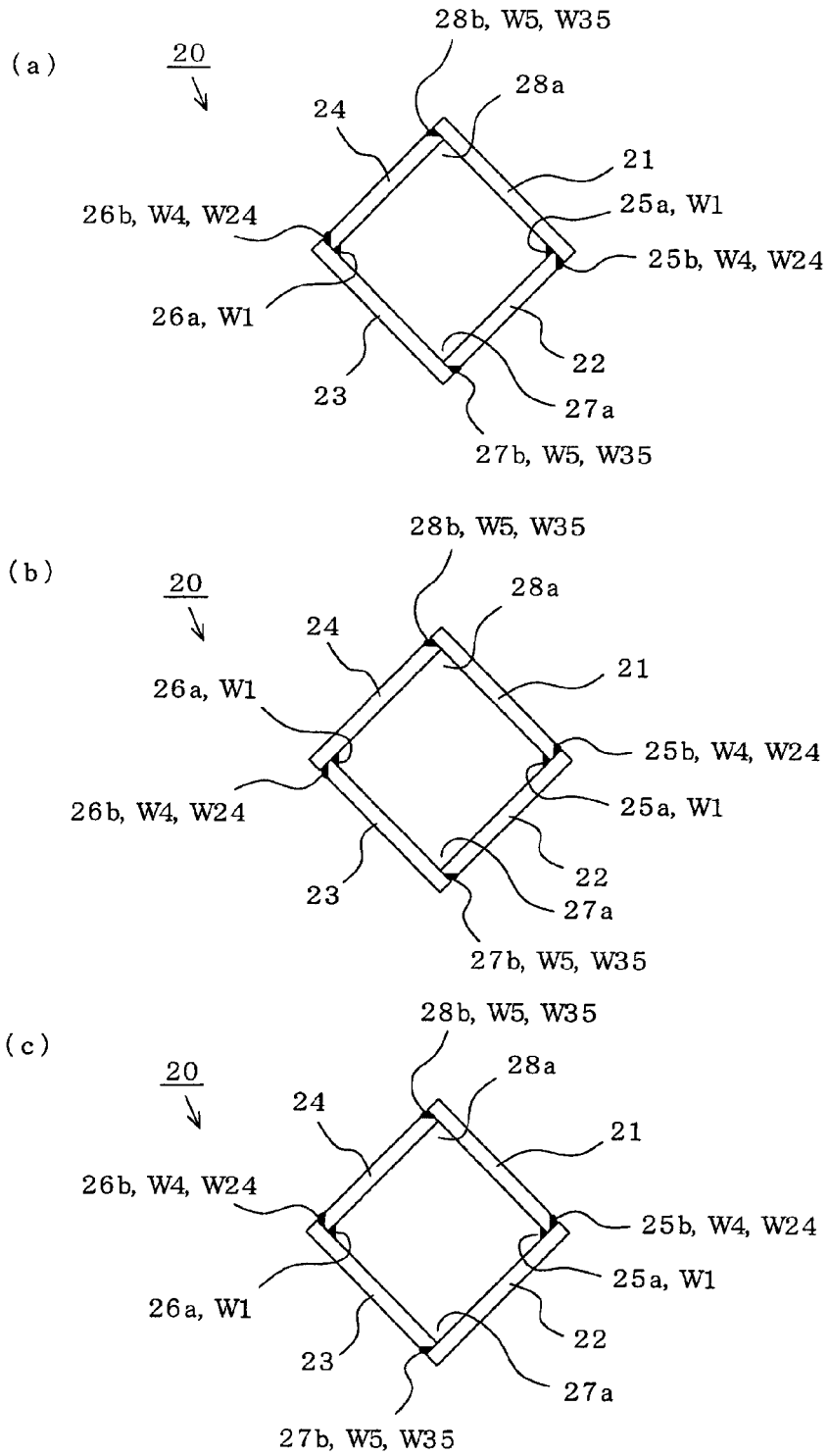
FIGS. 8(*a*) to 8(*c*) are front cross-sectional views schematically showing variations of a stiffening steel pipe in the method of manufacturing a steel pipe stiffening brace member according to the second embodiment.
Figure 9:
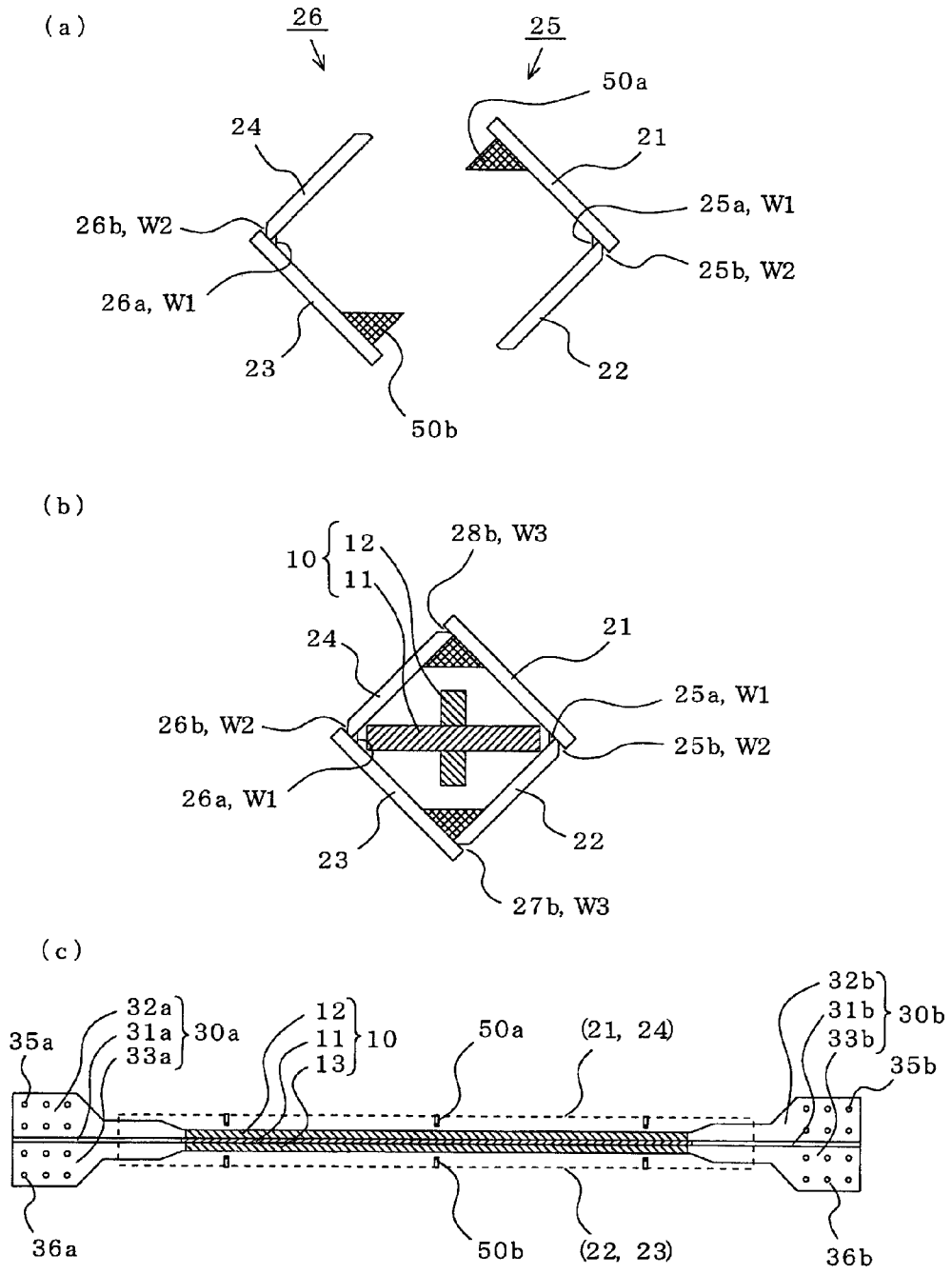
FIGS. 9(*a*) to 9(*c*) are partially transmitted side views schematically showing variations of a steel pipe stiffening brace member in the method of manufacturing a steel pipe stiffening brace member according to the second embodiment.

FIGS. 8(*a*) to 9(*c*) are views schematically showing variations of the stiffening steel pipe in the method of manufacturing a steel pipe stiffening brace member according to the second embodiment. FIGS. 8(*a*) to 8(*c*) are front cross-sectional views. FIGS. 9(*a*) and 9(*b*) are front cross-sectional views showing a manufacturing process, and FIG. 9C is a partially transmitted side view of a finished product. The same or corresponding components as those of the first embodiment are assigned the same reference numerals, and description thereof is partially omitted.

In FIG. 8(*a*), chamfering (C chamfering) process is applied to both side edges of the flat steels 22 and 24, and the flat steels 21 and 23 remain have a rectangular cross-sectional shape (see, FIG. 2). FIG. 6(*a*) which is a view for explaining the third embodiment shows an example corresponding to the stiffening steel pipe 20 of FIG. 8(*a*).

In FIG. 8(*b*), chamfering (C chamfering) process is applied to one side edges of all the flat steels 21, 22, 23, and 24.

In FIG. 8(*c*), chamfering (C chamfering) process is applied to one side edges of the flat steels 21 and 23 and both side edges of the flat steel 24, and the flat steel 22 remains have a rectangular cross-sectional shape. FIG. 6(*b*), which is a view for explaining the third embodiment, shows an example corresponding to the stiffening steel pipe 20 of FIG. 8C.

In FIG. 9(*a*), positioning members 50*a* and 50*b* are installed with predetermined intervals at three portions in the longitudinal direction of the side edges of the stiffening members 25 and 26 having a V-shaped cross section.

In the fifth process shown in FIGS. 9(*b*) and 9(*c*), the stiffening steel pipe 20 is temporarily assembled. At this time, the stiffening steel pipe 20 with high shape accuracy is temporarily assembled because the positioning members 50*a* and 50*b* facilitate positioning between the stiffening members 25 and 26 and enhance the matching accuracy of both.

Since the positioning members 50*a* and 50*b* are not strength members of the stiffening steel pipe 20, they are installed to such an extent that they serves to positioning (such as spot welding). The number of the positioning members 50*a* and 50*b* is not limited, and the positioning members 50*a* and 50*b* may be installed respectively to the flat steels 22 and 24 instead of the flat steels 21 and 23. Further, the positioning members 50*a* and 50*b* may be installed after the formation of the stiffening members 25 and 26 (after the execution of the fillet welding W1 and the partial penetration welding W2), and the stiffening members 25 and 26 may be formed using the flat steels 21 and 23 previously installed with the positioning members 50*a* and 50*b*.

INDUSTRIAL APPLICABILITY

According to the present invention, the need for bending work of flat steel is eliminated, and a stiffening steel pipe which suppresses bentness and warpage due to the influence of welding heat can be formed; therefore, the present invention can be widely used as a method of manufacturing brace members in various forms and a brace member manufactured by the manufacturing method.

REFERENCE SIGNS LIST

10 Shaft member
11 Main shaft member
12 Auxiliary shaft member
13 Auxiliary shaft member
20 Stiffening steel pipe
21 Flat steel
22 Flat steel
23 Flat steel
24 Flat steel
25 Stiffening member
25*a* Inside nook portion
25*b* Outside corner portion
26 Stiffening member
26*a* Inside nook portion
26*b* Outside corner portion
27*a* Inside nook portion
27*b* Outside corner portion
28*a* Inside nook portion
28*b* Outside corner portion
30 End member
31 Main end member
32 Auxiliary end member
33 Auxiliary end member
34 Through-hole
35 Through-hole
40 Liner plate

50 Positioning member
70 Welding machine
100 Steel pipe stiffening brace member
B1 Width (main shaft member)
B2 Width (auxiliary shaft member)
B3 Width (main end member)
B4 Width (auxiliary end member)
W1 Fillet welding
W2 Partial penetration welding
W3 Partial penetration welding
W4 Partial penetration welding
W5 Partial penetration welding
W24 Partial penetration welding
W35 Partial penetration welding

The invention claimed is:

1. A steel pipe stiffening brace member comprising:

a main shaft member formed of flat steel; and a stiffening steel pipe which surrounds the main shaft member to restrain out-of-plane deformation of the main shaft member, wherein the stiffening steel pipe comprises four flat steels butted and permanently affixed to each other, end edges of two of the flat steels affixed to side edges of two of the flat steels to form respective outside corner portions and to form at least one steel pipe inside nook portion facing an end edge of the main shaft member, thereby the stiffening steel pipe is formed to have a rectangular cross-sectional shape; and a welding material permanently affixed to each adjacent surface of the at least one inside nook portion facing the end of the main shaft member, the welding material being, in cross-section, generally triangular with a longest side thereof facing the end edge of the main shaft member.

2. The steel pipe stiffening brace member according to claim 1, wherein a liner plate is disposed in a gap between the inside nook portion of the stiffening steel pipe subjected to fillet welding and the end edge of the main shaft member.

3. The steel pipe stiffening brace member according to claim 1, wherein an auxiliary shaft member formed of flat steel is installed on a side surface of the main shaft member.

4. The steel pipe stiffening brace member according to claim 1, wherein an end member formed of flat steel with a width larger than a length of a diagonal of the stiffening steel pipe is installed at an end in a longitudinal direction of the main shaft member.

5. The steel pipe stiffening brace member according to claim 2, wherein an auxiliary shaft member formed of flat steel is installed on a side surface of the main shaft member.

6. The steel pipe stiffening brace member according to claim 2, wherein an end member formed of flat steel with a width larger than a length of a diagonal of the stiffening steel pipe is installed at an end in a longitudinal direction of the main shaft member.

7. The steel pipe stiffening brace member according to claim 3, wherein an end member formed of flat steel with a width larger than a length of a diagonal of the stiffening steel pipe is installed at an end in a longitudinal direction of the main shaft member.

8. A method of manufacturing a steel pipe stiffening brace member, the steel pipe stiffening brace member comprises a main shaft member formed of flat steel having opposite ends and a stiffening steel pipe formed of four flat steels surrounding the main shaft member to restrain out-of-plane deformation of the main shaft member, comprising the steps of:

butting a side edge of one of the four flat steels to an end of another of the four flat steels forming an inside nook portion and an outside corner portion and permanently welding the inside nook portion by fillet welding and intermittently temporarily welding the outside corner portion in a longitudinal direction by partial penetration welding to form a first stiffening member having a V-shaped cross section;

forming a second stiffening member;

butting edges of the stiffening members such that ends of the main shaft member face the permanently welded inside nook portions, welded by fillet welding, of the stiffening member, and intermittently temporarily welding the outside corner portions in the longitudinal direction by partial penetration welding to temporarily assemble the stiffening steel pipe having a rectangular cross section; and permanently welding the temporarily welded outside corner portions of the stiffening steel pipe by partial penetration welding and permanently assembling the stiffening steel pipe.

9. The method of manufacturing the steel pipe stiffening brace member according to claim 8, wherein the step of permanently assembling the stiffening steel pipe further comprises simultaneously permanently welding the two outside corner portions.

10. The method of manufacturing the steel pipe stiffening brace member according to claim 8, further comprising, before the step of temporarily assembling the stiffening steel pipe, disposing a liner plate in a gap between the permanently welded inside nook portion of the stiffening member and the side edge of the main shaft member.

11. The method of manufacturing the steel pipe stiffening brace member according to claim 8, wherein an auxiliary shaft member formed of flat steel is installed on a side surface of the main shaft member.

12. The method of manufacturing the steel pipe stiffening brace member according to claim 8, wherein an end member formed of flat steel with a width larger than a length of a diagonal of the stiffening steel pipe is installed at an end in a longitudinal direction of the main shaft member.

13. The method of manufacturing the steel pipe stiffening brace member according to claim 9, further comprising, before the step of temporarily assembling the stiffening steel pipe, disposing a liner plate in a gap between the permanently welded inside nook portion of the stiffening member and the side edge of the main shaft member.

14. The method of manufacturing the steel pipe stiffening brace member according to claim 9, wherein an auxiliary shaft member formed of flat steel is installed on a side surface of the main shaft member.

15. The method of manufacturing the steel pipe stiffening brace member according to claim 10, wherein an auxiliary shaft member formed of flat steel is installed on a side surface of the main shaft member.

16. The method of manufacturing the steel pipe stiffening brace member according to claim 9, wherein an end member formed of flat steel with a width larger than a length of a diagonal of the stiffening steel pipe is installed at an end in a longitudinal direction of the main shaft member.

17. The method of manufacturing the steel pipe stiffening brace member according to claim 10, wherein an end member formed of flat steel with a width larger than a length of a diagonal of the stiffening steel pipe is installed at an end in a longitudinal direction of the main shaft member.

18. The method of manufacturing the steel pipe stiffening brace member according to claim 11, wherein an end member formed of flat steel with a width larger than a length of a diagonal of the stiffening steel pipe is installed at an end in a longitudinal direction of the main shaft member.

* * * * *